US005721389A

United States Patent [19]

Kleindienst et al.

[11] Patent Number: 5,721,389

[45] Date of Patent: Feb. 24, 1998

[54] CARRYING AND/OR HOLDING DEVICE FOR MUSICAL PERCUSSION INSTRUMENTS

[75] Inventors: Anke Kleindienst, Bad Berleburg; Werner Sassmannshausen, Bad Berleburg-Wingeshausen, both of Germany

[73] Assignee: SONOR Johs. Link GmbH, Bad Berleburg, Germany

[21] Appl. No.: 522,416

[22] PCT Filed: Jan. 21, 1994

[86] PCT No.: PCT/EP94/00144

§ 371 Date: Oct. 23, 1995

§ 102(e) Date: Oct. 23, 1995

[87] PCT Pub. No.: WO95/20212

PCT Pub. Date: Jul. 27, 1995

[51] Int. Cl.[6] ..... G10D 13/02

[52] U.S. Cl. ..... 84/421; 224/910; 248/443

[58] Field of Search ..... 84/421, 453; 224/910; 248/443

[56] References Cited

U.S. PATENT DOCUMENTS

| | | | |
|---|---|---|---|
| 4,700,437 | 10/1987 | Hoshino | 84/421 |
| 5,544,561 | 8/1996 | Isomi | 84/421 |
| 5,573,158 | 11/1996 | Penn | 84/421 |

FOREIGN PATENT DOCUMENTS

| | | |
|---|---|---|
| 8803084 | 6/1988 | Germany . |
| 2210723 | 6/1989 | United Kingdom . |

*Primary Examiner*—Cassandra C. Spyrou
*Attorney, Agent, or Firm*—Friedrich Kueffner

[57] ABSTRACT

The invention relates to a carrying and/or holding device for musical percussion instruments, particularly with an attachment for an instrument, such as a tom-tom drum, wherein the attachment is fastened by means of an upper bearing and a lower bearing to the kettle of a bass drum in a vibration damping manner.

6 Claims, 2 Drawing Sheets

2
8
10
3
4
9
6
1
11
7
17
13
18
16
6
15
5
14
12

CARRYING AND/OR HOLDING DEVICE FOR MUSICAL PERCUSSION INSTRUMENTS

BACKGROUND OF THE INVENTION

From German Utility Model 88 03 084.9, it is known to arrange a flexible connecting or damping member of non-metal vibration-damping and/or vibration-absorbing material between a carrying member and a holding member of a carrying and/or holding device for musical percussion instruments. The carrying member is arranged on the instrument body, and the rigid holding member is fixed to a support, such as a leg, an arm, a stand and/or a frame. The holding member is located at the outer side of the instrument body or kettle and the carrying member is located at the inner side of the instrument body or kettle. The vibration breaker constructed in this manner is composed of a first section arranged between the carrying member and the inner side of the kettle, and a second section arranged between the holding member and the outer side of the kettle, wherein one of the sections additionally engages in openings of the kettle, and wherein tension rods between the holding member and the carrying member extend through the openings.

In musical percussion instruments, the damping members serving as bearings for the attachments have the purpose of preventing the transmission of mechanical vibrations from one instrument, for example, a bass drum, to another instrument, for example, a tom-tom mounted on the bass drum. As a rule, several different musical percussion instruments are combined for the intended use as a set of instruments, i.e., percussion instuments.

The invention is based on the object to facilitate improved vibration properties in a carrying and holding device of the above-mentioned type.

In accordance with the invention, this object is met by constructing the lower bearing as a pivot bearing. This makes it possible to achieve a damping characteristic which is automatically influenced from the outside by the respective weight of the instrument supported by the attachment. After mounting the instrument to be supported by the attachment, wherein the instrument is located above the lower bearing or the pivot bearing, just the load resulting from the weight of the instrument (tom-tom) alone results through the lever arm in an adjustment of the pivot bearing and, thus, in a spring action.

If, in accordance with a preferred development of the invention, the pivot bearing has a compression spring mounted between the kettle and the attachment, the spring effect provided by the pivot bearing is improved. Depending on the weight or the condition of loading, which is reinforced by beating on the tom-tom, the spring is either compressed or relaxed accordingly.

A development of the invention provides that the compression spring is enclosed by a bellows of vibration-damping and/or vibration-absorbing material. The bellows, for example, composed of a soft-elastic synthetic material or of rubber, improves the damping behavior of the pivot bearing which acts like a spring because the bellows can absorb any vibrations of the metal compression spring. Of course, it is possible to influence an adjustment of the spring-like properties to the respective weight of the instrument to be supported by the attachment by using compression springs having different spring strengths.

A proposal of the invention provides that the compression spring and the bellows are arranged on a threaded bolt of a knurled screw which is screwed into a lower holding stirrup of the attachment. In this manner, it is possible to pretension the compression spring in a variable manner and, thus, to carry out variations of the spring action and, consequently, of the sound behavior; this is because it is only necessary to screw the knurled screw more or less into the holding stirrup.

It is recommended to provide the free end of the threaded bolt of the knurled screw facing away from the head of the screw with a safety ring. This safety ring prevents an undesired unscrewing of the knurled screw of the holding stirrup, one the one hand, and, on the other hand, the safety ring constitutes a stop limiting the maximum opening, i.e., the state of relaxation of the compression spring.

It is proposed that the attachment or the carrying member is composed, in the known manner, of an upper and a lower holding stirrup which are fastened at the ends to the kettle through flexible connecting members, wherein the holding stirrups are connected to one another through a web-like connecting member arranged in the middle of the stirrups, and wherein the web-like connecting member has at its upper end a clamping device for a support arm receiving the instrument to be mounted and wherein the web-like connecting member has the pivot bearing at its lower end.

The pivot bearing acting as a spring can be provided in a simple manner on existing attachments which, accordingly, can be easily retrofitted.

Additional features and advantages of the invention result from the claims and the following description in which an embodiment of the subject of the invention is explained in more detail. In the drawing:

Figure 1:
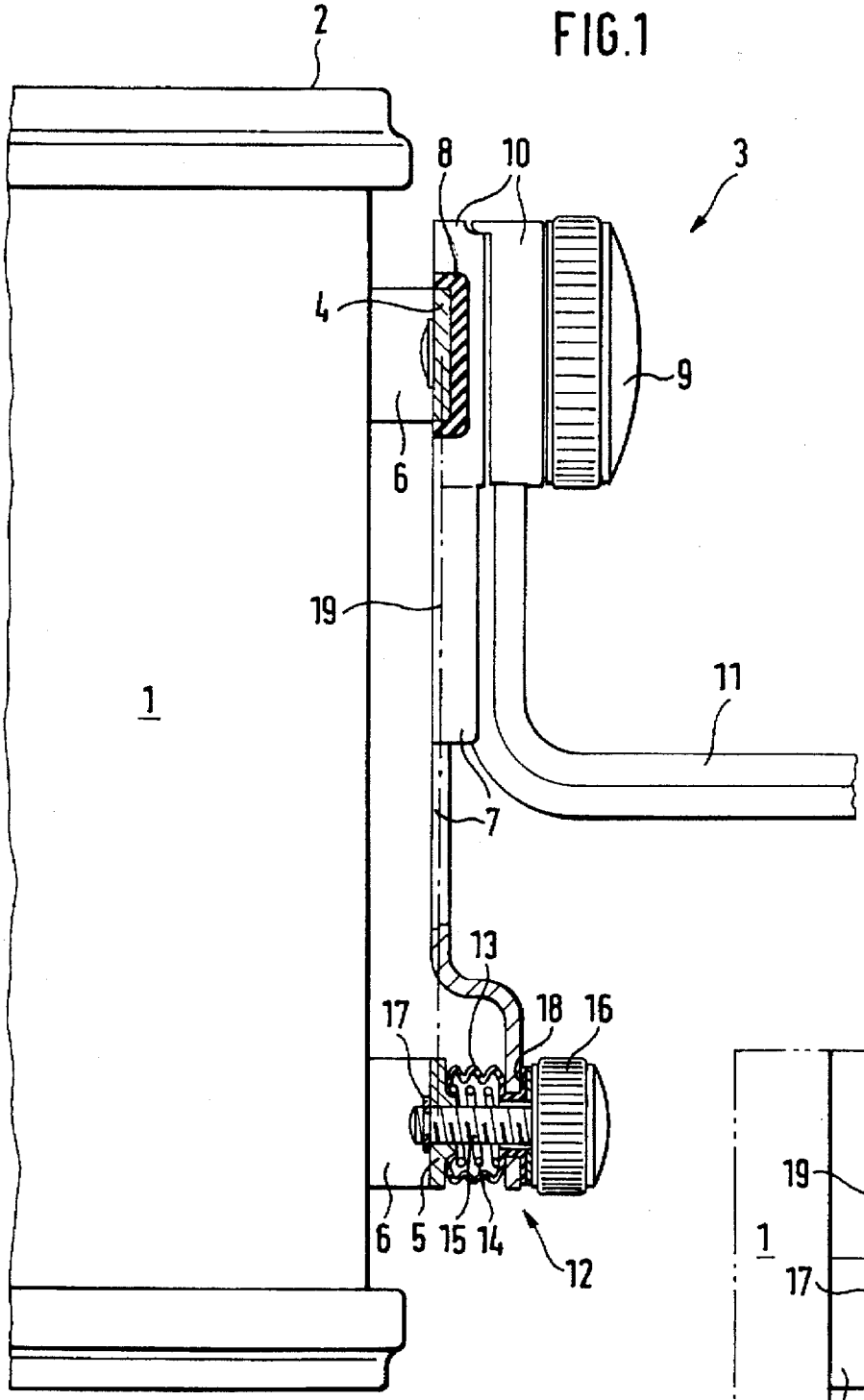
FIG. 1 is a side view, partially in section, of a carrying and/or holding device arranged on the kettle of a percussion drum with a lower bearing constructed as a pivot bearing for damping.
Figure 3:
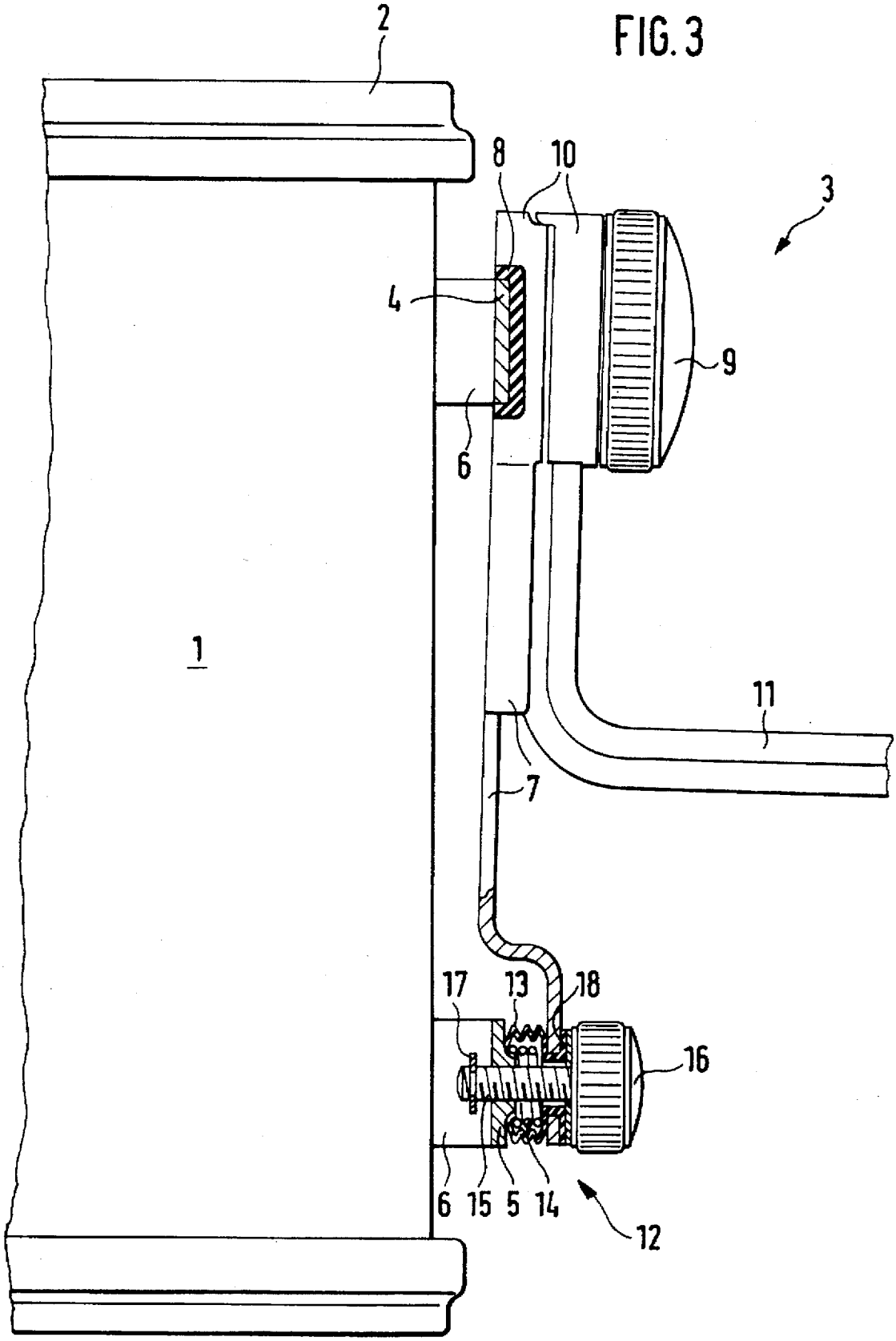
FIG. 3 is an illustration corresponding to FIG. 1 of the kettle of a percussion drum with a pretensioned compression spring of the pivot bearing.

As illustrated in FIGS. 1 and 3, an attachment 3 or a carrying and/or holding device is mounted on the kettle 1 of a percussion drum 2, wherein the attachment 3 extends over a partial circumference of the kettle 1. The attachment 3 is composed of an upper and a lower holding stirrup 4 and 5, respectively, which are arranged at a distance from the outer circumference of the kettle 1, and the angle-shaped stirrup ends 6 of the stirrups 4 and 5 are fastened to the kettle 1 through flexible connecting members (rubber sleeves), not shown. The two holding stirrups 4, 5 are connected to one another through a vertical connecting web 7 arranged in the stirrup middle between the stirrup ends 6.

The connecting web 7 is fastened to the upper holding stirrup 4 through an upper bearing constructed as a rubber bearing 8; at this location, the connecting web 7 additionally has a clamping device 10 to be actuated by means of a knurled nut 9 for a support arm 11 of section steel. Another instrument, for example, a tom-tom, can be arranged on the kettle 1 of the percussion drum 2 through the support arm 11 of the carrying device or the attachment 3. The lower end of the connecting web 7 is fastened to the lower holding stirrup 5 through a pivot bearing 12. The pivot bearing 12 has a compression spring 14 which is surrounded by a bellows 13 and is arranged between the kettle or the holding stirrup 5 and the attachment 3 or the connecting web 7. The compression spring 14 and the bellows 13 encasing the compression spring 14 are arranged on the threaded bolt 15 of a knurled screw 16 which is inserted through the connecting web 7 and is screwed into the lower holding stirrup 5. A safety ring 17 (safety or locking disc) slid onto the free end of the threaded bolt 15 limits the distance by which the knurled screw 16 can be unscrewed. The opening of the connecting web 7 for the threaded bolt 15 of the knurled screw 16 is constructed in a vibration-damping manner by means of washers of rubber or an inserted rubber sleeve 18.

Figure 2:
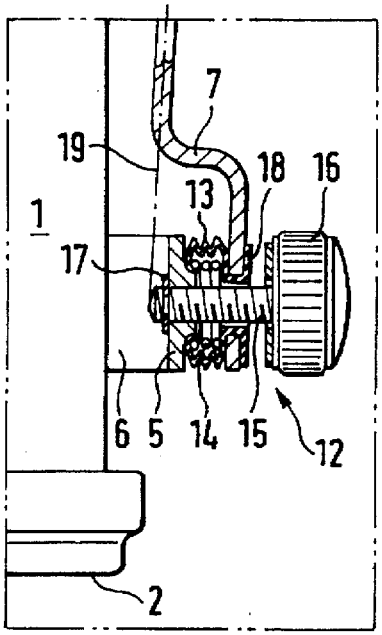
FIG. 2 shows as a detail the pivot bearing of FIG. 1 in the state loaded by a weight, i.e., when an instrument is supported by the attachment.

The pivot bearing 12 facilitates, through the compression spring 14 which is compressed or relaxed, a spring-like suspension of the carrying device or the attachment 3, and thus, of the instrument which is mounted on the support arm 11, wherein, consequently, the instrument is mounted in a vibration-damping manner. In the initial position illustrated in FIG. 1, the compression spring 14 is opened, i.e., relaxed. As soon as an instrument is fastened to the support arm 11, an adjustment of the connecting web 7 which compresses the compression spring 14 occurs, wherein this adjustment is reinforced as a result of the lever action between the bearing 8 of the connecting web 7 and the pivot bearing 12 mounted at the lower holding stirrup 5. Of course, the adjustment of the connecting member or connecting web 7 also occurs or is further reinforced if the instrument mounted on the support arm 11 is a tom-tom which is subjected to the beats of the musician, wherein the compression spring 14 assumes the compressed position shown in FIG. 2. In that case, the longitudinal axis 19 of the connecting member 7 changes its position relative to the outer circumference of the kettle 1 and assumes the inclined position schematically illustrated in FIGS. 1 and 2. As can be seen in FIG. 3, the initial tension of the compression spring 14 can be changed by screwing the threaded bolt 15 of the knurled screw 16 further into the holding stirrup 5 and, thus, by further compressing the compression spring 14; in that case, a harder suspension exists, wherein, however, the vibration properties of the pivot bearing 5 are simultaneously reduced. Accordingly, by changing the initial tension, variations in the spring action of the pivot bearing 12 and, thus, of the sound behavior of the instrument can be achieved. The illustration of FIG. 3 does otherwise not differ from that of FIG. 1, so that the same components are provided with the same reference numerals even if they have not been mentioned once again in connection with FIG. 3.

List of reference numerals:

1 kettle
2 percussion drum
3 attachment
4 upper holding stirrup
5 lower holding stirrup
6 stirrup end
7 connecting web/member
8 rubber bearing
9 knurled nut
10 clamping device
11 support arm
12 pivot bearing
13 bellows
14 compression spring
15 threaded bolt
16 knurled screw
17 safety ring
18 rubber sleeve
19 longitudinal axis

We claim:

1. A carrying and/or holding device for a musical percussion instrument comprising an attachment for fastening another instrument to the percussion instrument, the percussion instrument having a kettle, the attachment comprising at least one upper bearing and one lower bearing fastened to the kettle, and a connecting member having upper and lower ends, wherein the lower bearing is constructed as a pivot bearing, and wherein the lower end of the connecting member is fastened to the pivot bearing so as to be radially moveable toward and away from the kettle.

2. The device according to claim 1, wherein the pivot bearing comprises a compression spring mounted between the kettle and the attachment.

3. The device according to claim 2, further comprising a bellows of at least one of a vibration-damping and vibration-absorbing material enclosing the compression spring.

4. The device according to claim 3, wherein the attachment comprises an upper holding stirrup and a lower holding stirrup, further comprising a knurled screw having a threaded bolt screwed into the lower holding stirrup, wherein the compression spring and the bellows are mounted on the threaded bolt.

5. The device according to claim 4, wherein the threaded bolt of the knurled screw has a free end facing away from a knurled head of the knurled screw, further comprising a safety ring mounted on the free end of the threaded bolt.

6. The device according to claim 1, wherein the attachment comprises upper and lower holding stirrups having ends connected through the connecting member to the kettle, wherein the attachment has at the upper end thereof a clamping device for a support arm for receiving the another instrument.

* * * * *